US010136725B2

(12) United States Patent
Mueller

(10) Patent No.: US 10,136,725 B2
(45) Date of Patent: Nov. 27, 2018

(54) OUTDOOR CONVERTIBLE TABLE-LIKE FURNITURE WITH MULTIPLE LEVELS

(71) Applicant: Plank and Hide, Cincinnati, OH (US)

(72) Inventor: Erik Mueller, Loveland, OH (US)

(73) Assignee: Plank and Hide, Cincinnati, OH (US)

( * ) Notice: Subject to any disclaimer, the term of this patent is extended or adjusted under 35 U.S.C. 154(b) by 29 days.

(21) Appl. No.: 15/248,605

(22) Filed: Aug. 26, 2016

(65) Prior Publication Data

US 2018/0055218 A1 Mar. 1, 2018

(51) Int. Cl.

| | |
|---|---|
| ***A47B 31/00*** | (2006.01) |
| ***A47B 3/06*** | (2006.01) |
| ***A47B 3/12*** | (2006.01) |
| ***B65D 25/04*** | (2006.01) |
| ***B65D 25/28*** | (2006.01) |
| ***B65D 43/02*** | (2006.01) |
| ***B65D 21/08*** | (2006.01) |
| ***A47B 37/04*** | (2006.01) |

(52) U.S. Cl.

CPC ..... *A47B 31/00* (2013.01); *A47B 3/06* (2013.01); *A47B 3/12* (2013.01); *A47B 37/04* (2013.01); *B65D 21/083* (2013.01); *B65D 25/04* (2013.01); *B65D 25/28* (2013.01); *B65D 43/02* (2013.01); *A47B 2031/002* (2013.01); *A47B 2031/003* (2013.01); *A47B 2031/008* (2013.01); *B65D 2525/283* (2013.01)

(58) Field of Classification Search

CPC ..... A47B 47/05

USPC ..... 312/265.1, 265.2, 265.3, 264.4, 334.5, 312/351.11, 351.12, 351.13

See application file for complete search history.

(56) References Cited

U.S. PATENT DOCUMENTS

| | | | | |
|---|---|---|---|---|
| 2,476,542 A | | 7/1949 | Gauss | |
| 4,674,806 A | * | 6/1987 | Kroon | B60B 33/0078 16/35 R |
| 4,883,331 A | * | 11/1989 | Mengel | A47B 13/003 312/195 |
| D439,446 S | | 3/2001 | Harrison | |

(Continued)

FOREIGN PATENT DOCUMENTS

| | | |
|---|---|---|
| DE | 102010011575 A1 | 9/2011 |
| FR | 2643978 A1 | 9/1990 |

(Continued)

*Primary Examiner* — Matthew W Ing

(74) *Attorney, Agent, or Firm* — Wood Herron & Evans LLP

(57) ABSTRACT

A convertible outdoor patio table is provided. The table includes a metallic frame mounted on wheels, the frame surrounding a generally hollow interior, an outer body member which is coupled to and substantially surrounds side portions of the frame, the outer body member being made of a weather resistant material, a railing coupled to the frame and defining a shoulder positioned adjacent the outer body member at the generally hollow interior, a tabletop lid member which removably engages with at least one of the shoulder or the outer body member to close the generally hollow interior, and a functional/storage device which is revealed for access and use when the tabletop lid member is disengaged from the outer body member. The functional/storage device substantially covers a surface area bounded at the top end of the frame to maximize usage of space within the generally hollow interior.

17 Claims, 15 Drawing Sheets

(56) References Cited

U.S. PATENT DOCUMENTS

| | | | | |
|---|---|---|---|---|
| 6,997,111 | B2 | 2/2006 | Giegerich | |
| 7,007,813 | B2 | 3/2006 | Yang | |
| D596,892 | S | 7/2009 | Vanderminden | |
| 8,166,893 | B2 | 5/2012 | Davis | |
| 8,561,602 | B2 | 10/2013 | Andors et al. | |
| 2005/0122015 | A1* | 6/2005 | Hightower | A47B 67/04 312/334.5 |
| 2008/0029000 | A1* | 2/2008 | Thornbury | A47B 37/04 108/150 |
| 2008/0272677 | A1* | 11/2008 | Francisquini | H02B 1/301 312/257.1 |
| 2013/0038187 | A1* | 2/2013 | De Filippis | G07G 1/0027 312/237 |
| 2013/0081609 | A1 | 4/2013 | Dhuper et al. | |
| 2013/0160679 | A1 | 6/2013 | Federici et al. | |
| 2013/0239943 | A1 | 9/2013 | James | |

FOREIGN PATENT DOCUMENTS

| | | | |
|---|---|---|---|
| JP | 2006105470 | A | 4/2006 |
| RU | 2082064 | C1 | 6/1997 |

* cited by examiner

OUTDOOR CONVERTIBLE TABLE-LIKE FURNITURE WITH MULTIPLE LEVELS

TECHNICAL FIELD

This invention relates to outdoor patio furniture and, more specifically, to outdoor table-like furniture that can be reconfigured for use in multiple manners.

BACKGROUND

A lack of available space is a common problem on patios and decks. Multi-function furniture adds variety to the types of entertainment possible on such patios or decks. For example, fire pits have been incorporated with patio furniture to allow users to cleanly and safely enjoy the pleasures of a fire on patios, porches, and other areas where containing a fire had proved difficult and dangerous. Further, small ice buckets have been incorporated into tables to provide convenient access to beverages or various dips and sauces. However, these tables often leave available space underutilized or unused when the added features, such as ice buckets and fire pits, are not actively in use. Likewise, such conventional patio furniture is generally limited to providing one type of functionality, so elements like ice buckets, chip and dip bowls, garbage containers, and fire pits need to be provided in separate elements which take up space.

A need exists, therefore, for a table that allows a user to maximize the available space in a table designed for multi-functional use.

SUMMARY

In accordance with one aspect of the invention, a convertible outdoor patio table includes a metallic frame configured to be mounted on wheels, the frame defining a top end, a bottom end configured to be connected to the wheels, and side portions extending between the top end and the bottom end, the frame surrounding a generally hollow interior. The table further includes an outer body member which is coupled to and substantially surrounds the side portions of the frame, the outer body member being at least partially made of a weather resistant material. Also included is a railing coupled to the frame proximate the top end and defining a shoulder positioned adjacent the outer body member at the generally hollow interior. The table further includes a tabletop lid member which removably engages with at least one of the shoulder and the outer body member adjacent the top end of the frame to close the generally hollow interior from an external environment and provide a generally planar tabletop surface for supporting various articles. The tabletop lid member is made at least partially of a weather resistant material. The table also includes a functional/storage device which is revealed for access and use when the tabletop lid member is disengaged from the outer body member. The functional/storage device removably engages with the shoulder and substantially covers a surface area bounded by the railing to maximize usage of space within the generally hollow interior. For example, the functional/storage device in one embodiment covers an entire surface area bounded by the railing.

In one embodiment, the tabletop lid member includes an inner backing layer formed from a plastic material and an outer decorative layer, such that each layer of the tabletop lid member is weather resistant. The outer body member may also be formed with a similar construction and materials.

In another embodiment, the convertible outdoor patio table further includes one or more pins coupled to the tabletop lid member and one or more apertures in the outer body member. Each of the one or more pins is insertable into one of the one or more apertures to removably engage the tabletop lid member and the outer body member. Alternatively, the tabletop lid member may be configured to be supported on top of the railing, with a periphery of the outer body member surrounding the outer edges of the tabletop lid member to collectively define the generally planar tabletop surface. Regardless of the particular arrangement for securing the tabletop lid member with the remainder of the patio table, the patio table is easily converted between a state where a generally planar tabletop surface is provided and a state where the functional/storage device is revealed for use. Thus, the patio table advantageously maximizes use of space and provides numerous desired functions in the outdoor furniture field.

In other embodiments, the functional/storage device may be a unitary storage receptacle defining an ice chest, a compartmented container defined by multiple storage receptacles, or a garbage container. Various other options for functional/storage devices may be used without departing from the scope of this disclosure.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
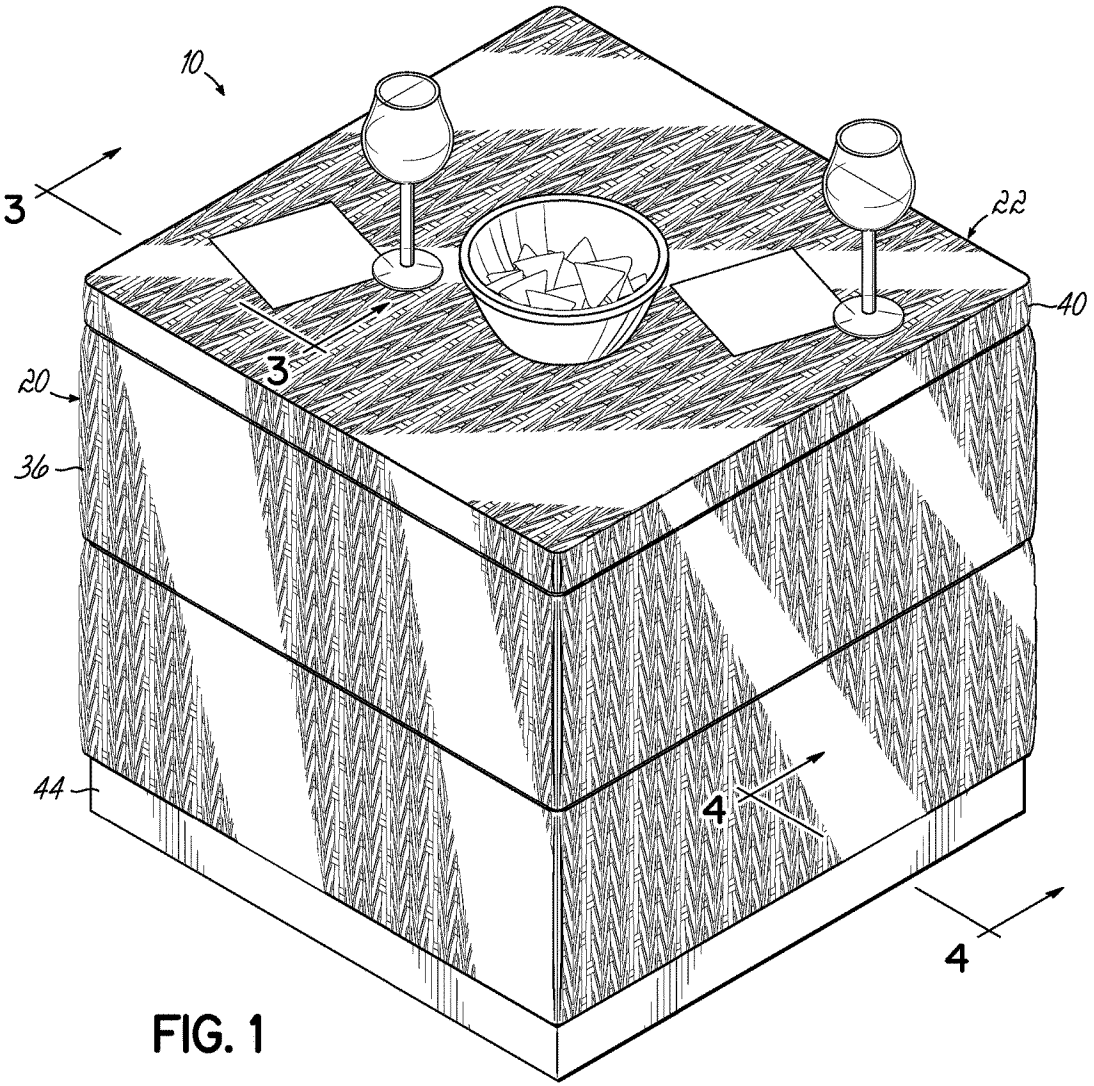
FIG. 1 is a perspective view of a patio table in accordance with an embodiment of the invention and with one embodiment of a tabletop lid member in a closed position.

With initial reference to FIGS. 1 through 4, in an embodiment of the present invention, a convertible outdoor patio table 10 includes a metallic frame 12 that defines a top end 14, a bottom end 16, and side portions 18 extending between the top end 14 and the bottom end 16. The frame 12 surrounds a generally hollow interior 19. The table 10 further includes an outer body member 20 that is coupled to and substantially surrounds the side portions 18 of the frame 12. To this end, the frame 12 may be formed by generally hollow aluminum bar sections having square or rectangular cross-sections, with the outer body member 20 partially wrapping around the bar sections to enclose them. The table 10 also includes a tabletop lid member 22 that is configured for removable engagement with the outer body member 20 adjacent the top end 14 of the frame 12 to close the generally hollow interior 19 from an external environment. The outer body member 20 and the tabletop lid member 22 may be made at least partially of a weather resistant material. When the tabletop lid member 22 is positioned on the frame 12, it provides a generally planar tabletop surface for supporting various articles, such as in the configuration shown in FIG. 1. Advantageously, this tabletop surface is not limited by space-filling features associated with a functional/storage device contained within the patio table 10 and described further below, and this functional/storage device is configured to use a maximum amount of the surface area or space revealed when the tabletop lid member 22 is removed. Therefore, the patio table 10 of this embodiment provides multiple functions for a user while maximizing the space that may be used for the different functions, which is desirable in the space-constrained environment of many outdoor patios and decks.

Figure 2A:
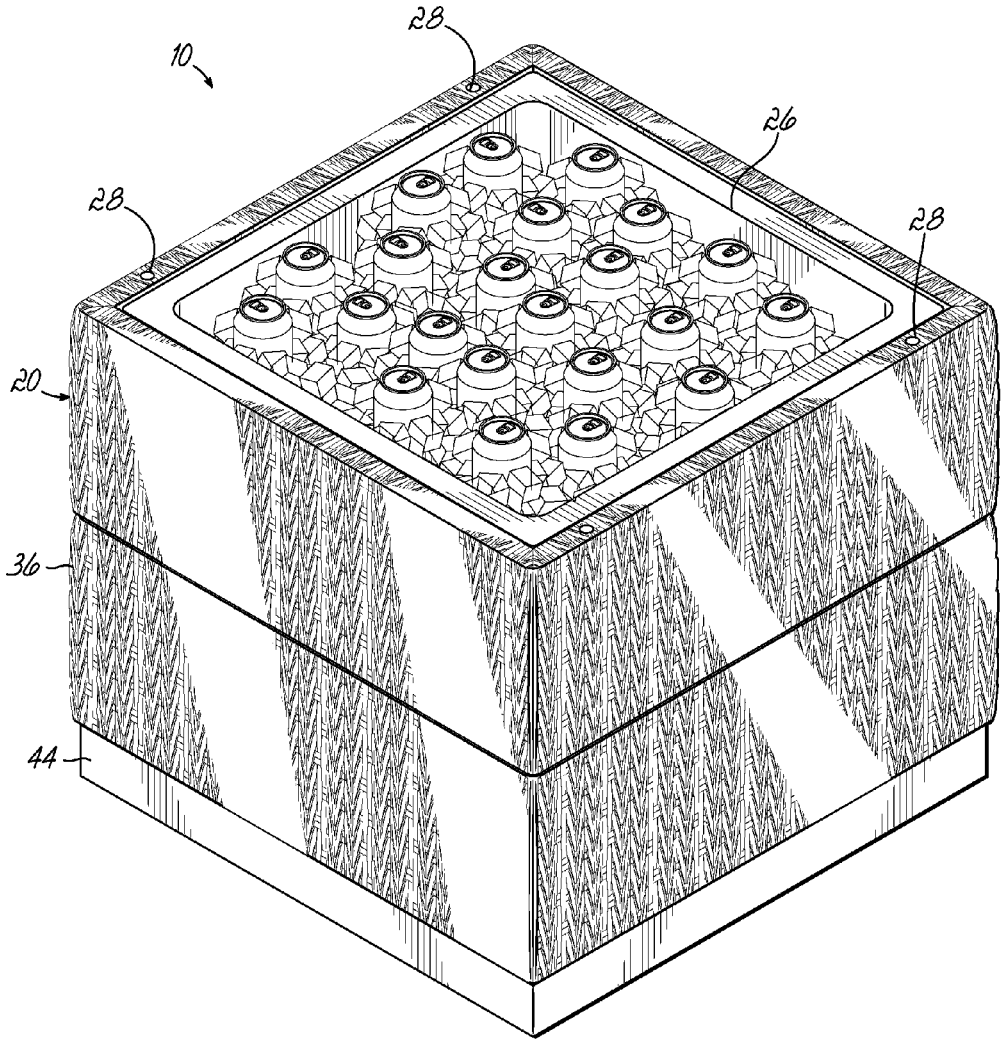
FIG. 2A is a perspective view of the table of FIG. 1 with the tabletop lid member removed to reveal an opening filled with a unitary ice bucket containing ice and beverage cans.
Figure 2B:
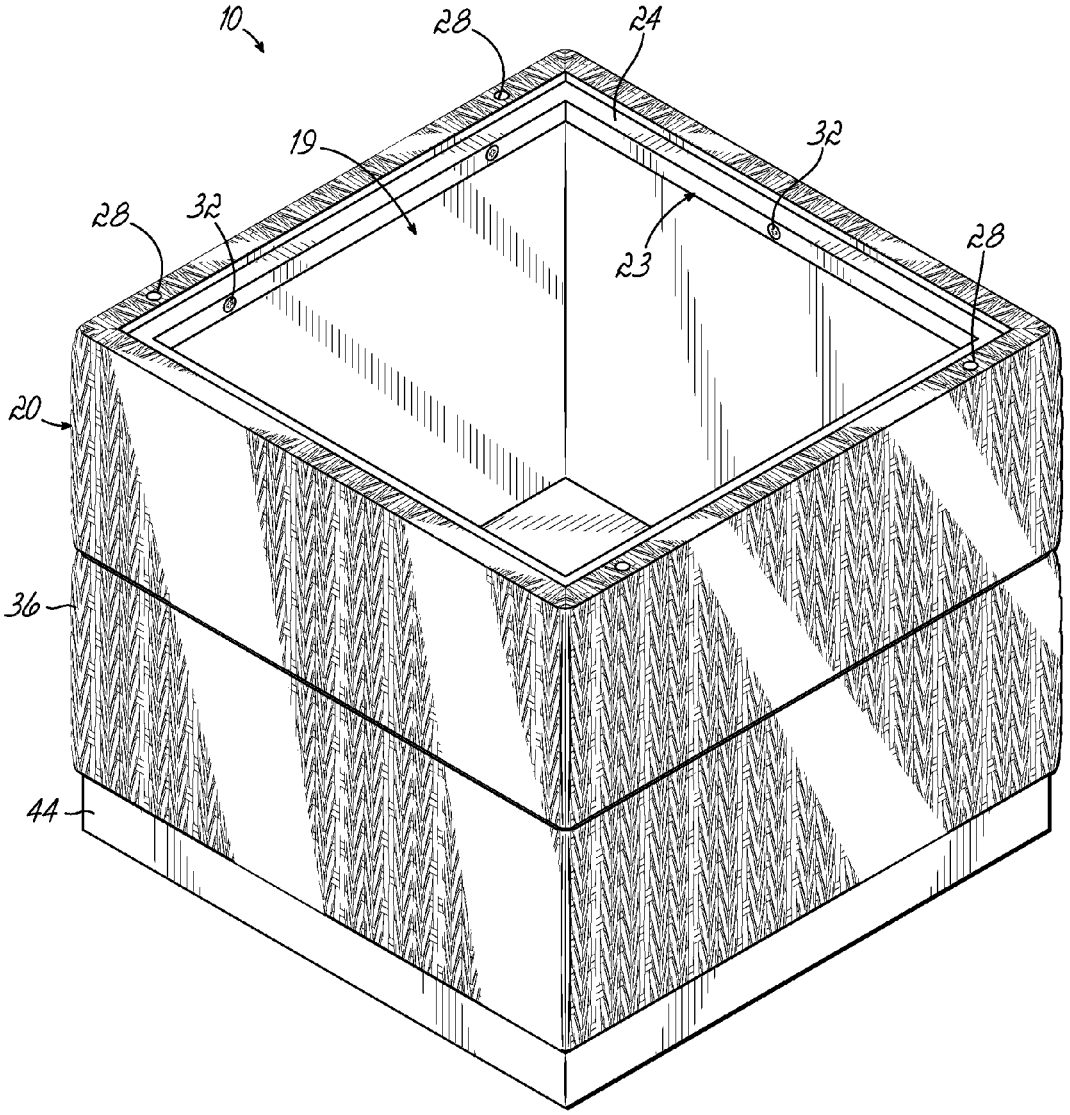
FIG. 2B is a perspective view of the table of FIG. 2A with the table top and the ice bucket removed to reveal an empty opening, thereby revealing support structures such as a railing defining a shoulder located within the interior thereof.

With further reference to FIGS. 2A and 2B, the table 10 is shown in more detail with the tabletop lid member 22 removed. A railing 23 defines a shoulder 24 and is coupled to the top end 14 of the frame 12 (such as with fasteners as described with reference to FIG. 3 below, or with other similar coupling elements) and is positioned adjacent the outer body member 20 at the generally hollow interior 19. Alternatively, the railing 23 may be coupled to the frame 12 at a distance from the top end 14 (not shown) so that the shoulder 24 is recessed in the generally hollow interior 19. The shoulder 24 is configured to support a functional/storage device, which is revealed for access and use when the tabletop lid member 22 is disengaged from the outer body member 20. As shown in FIG. 2A, the functional/storage device, which is illustrated as a unitary storage receptacle 26 that defines an ice chest, covers an entire surface area bounded at the top end 14 of the frame 12 to maximize usage of space within the generally hollow interior 19 in this configuration of the patio table 10. In other words, the functional/storage device is configured in this and other embodiments to "substantially cover" the surface area bounded by the railing 23, which is defined as covering the entirety of the surface area or covering a significant majority portion thereof (e.g., almost the entirety of the surface area bounded by the railing 23) within the scope of this invention. To this end, the outer body member 20 may define a height of 15 inches (the entire patio table 10 defining a height of about 18.875 inches) in the embodiment shown in these Figures, and the unitary storage receptacle 26 may have a corresponding depth of 15 inches. As readily understood from those exemplary dimensions for this embodiment, the unitary storage receptacle 26 maximizes use of available storage space within the patio table 10.

In embodiments like the one illustrated where the unitary storage receptacle 26 is configured for use as an ice chest or ice bucket, a drain mechanism (not shown) may be provided in the patio table 10 to drain melted ice and water from the storage receptacle 26 without necessitating inversion or tipping of the entire patio table 10. One example of such a drain mechanism is provided in U.S. patent application Ser. No. 15/222,235 to Mueller et al., which is expressly incorporated herein by reference in its entirety, and which has been developed and is owned by the original assignee of this application.

Figure 3:
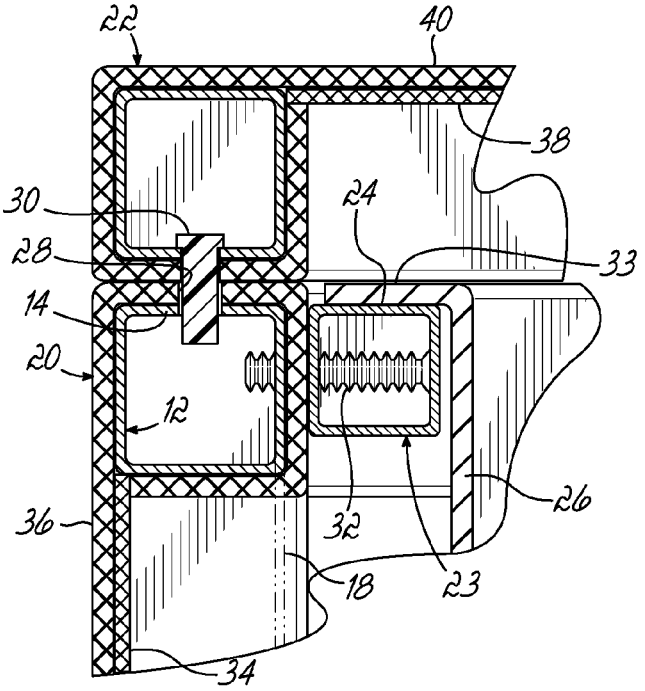
FIG. 3 is a detailed cross-sectional view of the table of FIG. 1, taken along line 3-3, with the table top in a closed position, showing connection details of the tabletop lid member, the railing, and the ice bucket at a top end of the patio table in accordance with this embodiment.
Figure 13:
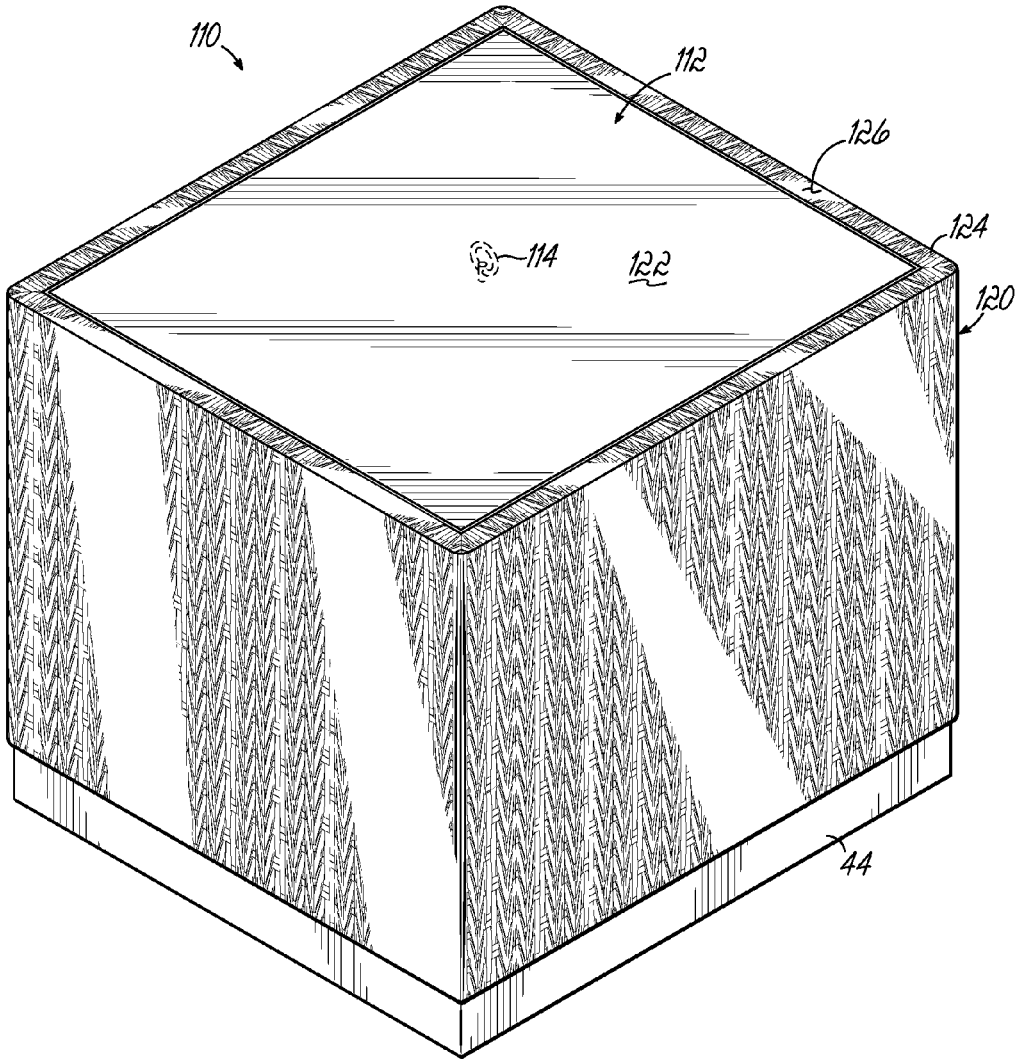
FIG. 13 is a top isometric view of a patio table in accordance with another embodiment of the invention, showing the ornamental features thereof.
Figure 14:
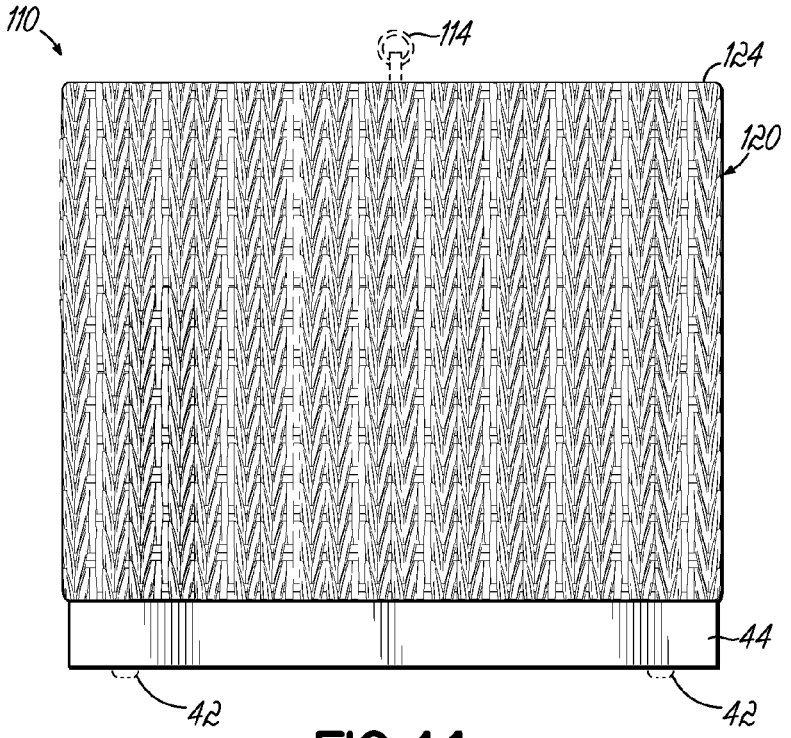
FIG. 14 is a front view of the table of FIG. 13, with the rear view being identical.
Figure 15:
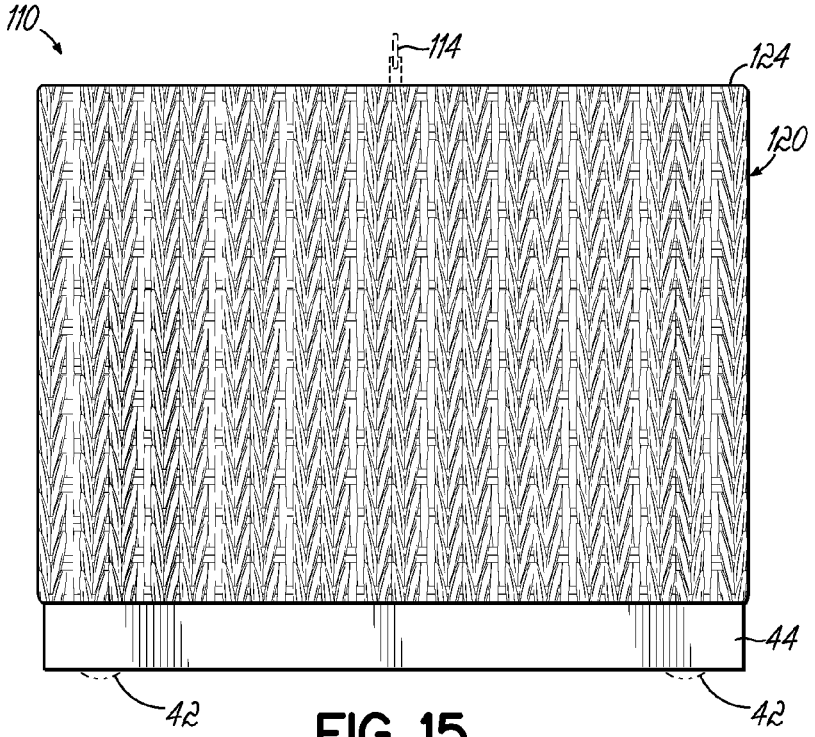
FIG. 15 is a right side view of the table of FIG. 13, with the left side view being identical.
Figure 16:
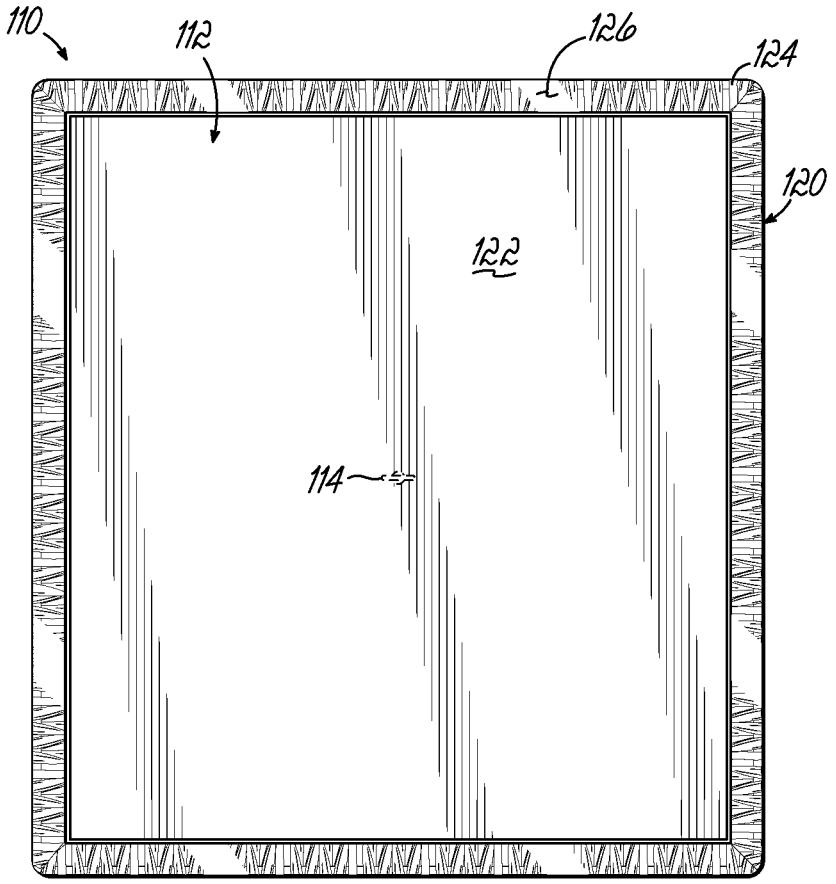
FIG. 16 is a top view of the table of FIG. 13.

With reference now to FIG. 3, the outer body member 20 and the tabletop lid member 22 are shown in further detail adjacent the top end 14 of the frame 12. As described above, the outer body member 20 and the tabletop lid member 22 are removably engaged. To that end, the outer body member 20 includes apertures 28 adjacent the top end 14 of the frame 12. It will be understood that such apertures 28 may optionally extend through a portion of the frame 12 as well. The tabletop lid member 22 includes pins 30 corresponding in position and size to the apertures 28. When the tabletop lid member 22 is properly positioned on top of the outer body member 20, the apertures 28 secure the pins 30 to prevent lateral movement of the tabletop lid member 22. It will be understood that the tabletop lid member 22 may include a handle feature (for example, like the one shown in FIG. 13) to assist users with removal and placement of the tabletop lid member 22.

Also in FIG. 3, the railing 23 and shoulder 24 are shown in more detail. The railing 23 is coupled to the top end 14 of the frame 12 via threaded fasteners 32. An outwardly projecting lip 33 of the unitary storage receptacle 26 is supported by the shoulder 24. It will be understood that while threaded fasteners 32 are used to couple the railing 23 and the frame 12 in the illustrated embodiment, other types of joining elements such as clamps and adhesive may be used in other embodiments within the scope of this disclosure. The threaded fasteners 32 enable removal and replacement of the railing 23 when reconfiguration of what the hollow interior 19 is to be used for is desired. Furthermore, although the railing 23 is shown as being formed form generally hollow and elongate bar-like sections of square or rectangular cross-section, the specific shape, size and materials defining the railing 23 and the shoulder 24 may be modified in other embodiments.

With further reference to FIG. 3, the outer body member 20 of this embodiment includes an inner backing layer 34 formed from a plastic material and an outer decorative layer 36, such that each of the inner backing layer 34 and the outer decorative layer 36 is weather resistant. Similarly, the tabletop lid member 22 also includes an inner backing layer 38 formed from a plastic material and an outer decorative layer 40 such that each layer 38, 40 of the tabletop lid member 22 is weather resistant. An exemplary material for each of the inner backing layers is polyvinyl chloride, and an exemplary material for each of the outer decorative layers is wicker. In another embodiment, the outer decorative layers of the outer body member 20 and the tabletop lid member 22 may be different. For example, the outer decorative layer 40 of the tabletop lid member 22 may be weather-resistant wood or laminate. In still further embodiments, the inner backing layer 34 of the outer body member 20 may be omitted. To summarize, the outer body member 20 and the tabletop lid member 22 and their components are formed from a weather-resistant material or materials, such as aluminum, other metals, plastics, resins, wood materials (such as teak or treated wood configured to resist water damage), and the like. Regardless of the particular materials chosen for these elements, the exterior defined by the patio table 10 is configured to withstand all environmental conditions for outdoor use, while also protecting the hollow interior 19 from the elements like rain and/or snow. Of course, a decorative slip cover could also be provided for covering the table 10 when not in use.

Figure 4:
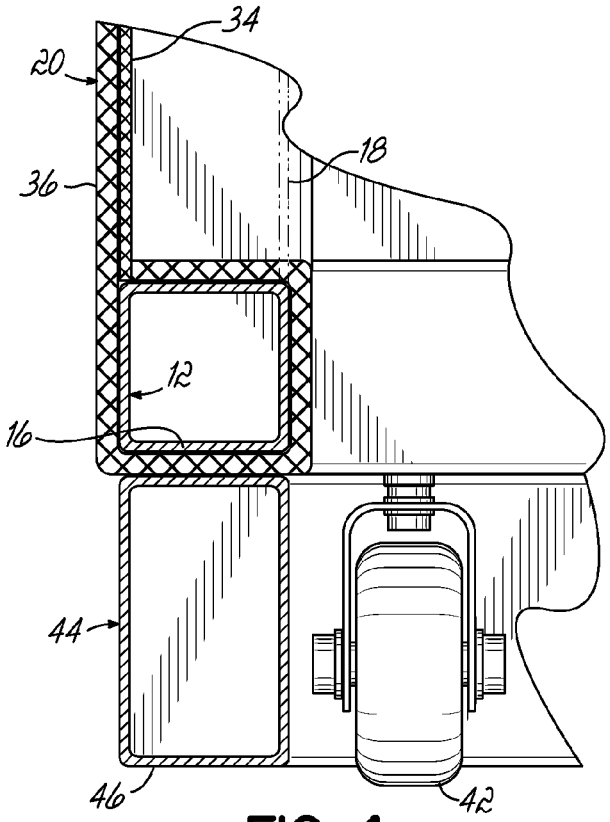
FIG. 4 is a detailed cross-sectional view of the table of FIG. 1, taken along line 4-4, showing wheel and frame details near a bottom end of the patio table.

Now with reference to FIG. 4, the frame 12 is shown in further detail adjacent the bottom end 16 thereof. The frame 12 is connected to wheels 42. More specifically, the bottom end 16 of the frame 12 is mounted on the wheels 42. The wheels 42 may be, for example, swivel casters, as shown in the illustrated embodiment. Other types of wheels or ground supports known for use with outdoor grills and similar furniture items may be used in alternative embodiments. Also coupled to the bottom end 16 of the frame 12 in this embodiment is a skirt 44, which primarily acts to conceal the wheels 42. In an embodiment, the skirt 44 may be made of aluminum with a height of, for example, 2 inches. The skirt 44 may also be formed as a unitary part with the metallic frame 12 in some embodiments. Further, a bottom edge of each wheel extends farther from the bottom end 16 of the frame 12 than the bottom surface 46 of the skirt 44. In other words, there is a gap between the bottom surface 46 of the skirt 44 and the surface on which the table 10 is positioned so the skirt 44 does not interfere with the movement of the table 10 on the wheels 42. For example, there may be a ½ inch gap between the bottom surface 46 of the skirt 44 and the surface (e.g., a patio surface or a deck surface).

Figure 5:
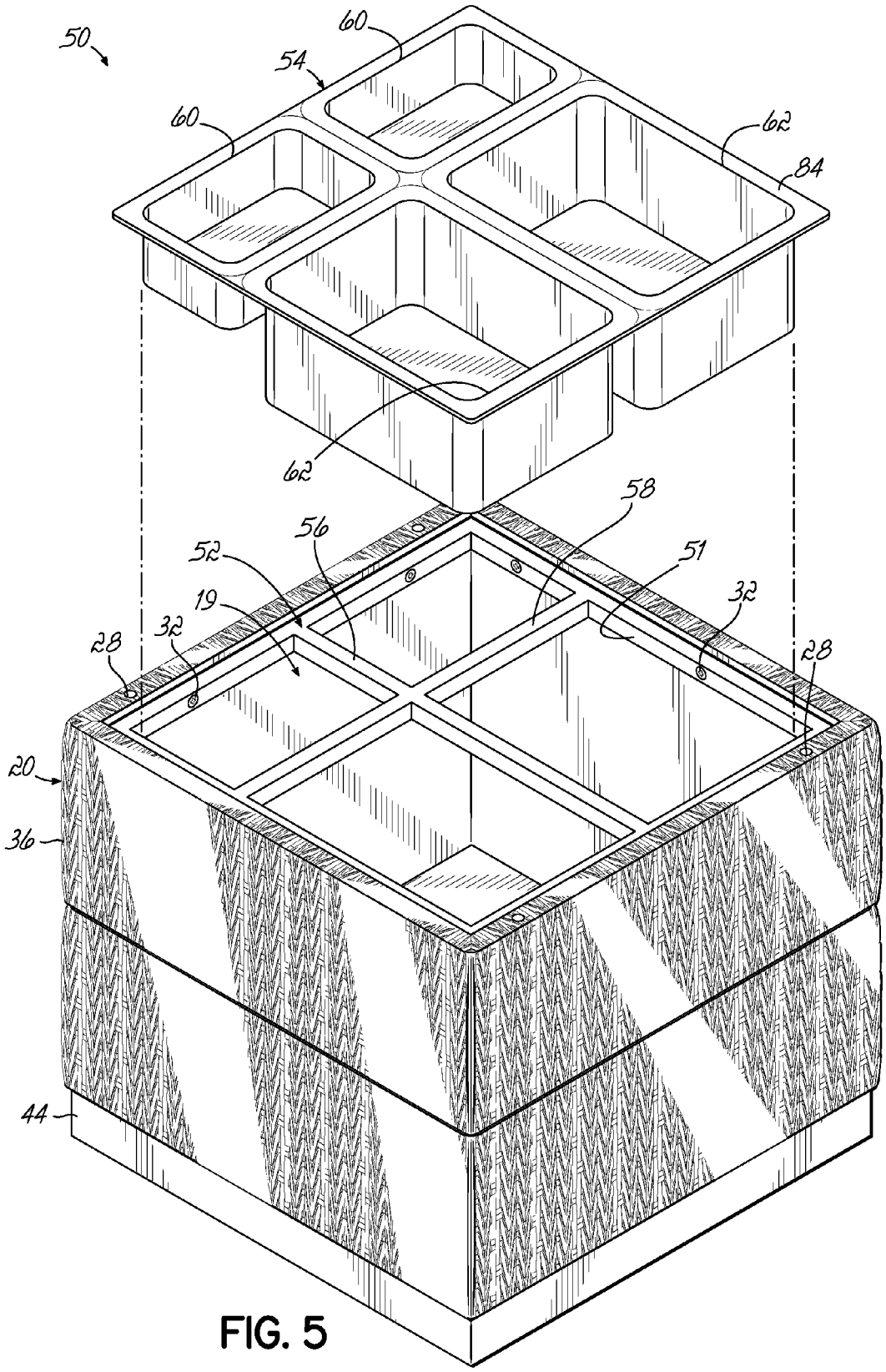
FIG. 5 is an exploded perspective view of a patio table in accordance with another embodiment of the invention and with a tabletop lid member removed to reveal a railing and other support structures associated with a multi-bin arrangement in the interior thereof.

With reference to FIG. 5, in another embodiment of the invention, a convertible outdoor patio table 50 is shown. The same elements from prior embodiment(s) are labeled with the same reference numbers where they remain substantially identical, without a corresponding repeat of the description herein. Coupled to the top end 14 of the frame 12 is a railing 51 defining a shoulder 52 positioned adjacent the outer body member 20 at the generally hollow interior 19. The shoulder 52 is configured to support a functional/storage device, illustrated as a compartmented container 54, which is revealed for access and use when the tabletop lid member 22 (not shown in FIG. 5) is disengaged from the outer body member 20. The compartmented container 54 includes an outwardly-projecting lip 84 along its periphery that sits atop the shoulder 52 to position the compartmented container 54 adjacent the top end 14 of the frame 12 in this embodiment. The configuration of the railing 51 may be altered depending on the intended use. For example, to better support all portions of the compartmented container 54, the railing 51 of this embodiment includes crossbars 56, 58 that extend across the open surface area at the top of the hollow interior 19. However, in all other respects, the railing 51 and shoulder 52 are substantially similar to the railing 23 and shoulder 24 shown in the previous embodiment.

The crossbars 56, 58 may be formed integrally with or separately coupled to the peripheral part of the railing 51 (integral formation being shown in the Figure), and the crossbars 56, 58 may vary in position from the illustrated embodiment to vary with varying compartment sizes. To this end, as described in a further alternative embodiment shown in FIGS. 7A and 7B below, the crossbars 56, 58 may also be provided on a secondary railing member which is configured to engage with the railing 51 that is secured within the hollow interior 19 of the table 50. That configuration would enable the crossbars 56, 58 to also be removable after the compartment container 54 is removed, to provide better access into the hollow interior 19 and possibly further items located below the railing 51 in some embodiments. In this regard, the table 50 of this and other embodiments are capable of receiving multiple functional/storage devices to allow multiple functionalities to be served by a single table 50.

The compartmented container 54 substantially covers the surface area bounded at the top end 14 of the frame 12 to maximize usage of space within the generally hollow interior 19. The compartmented container 54 may be used to hold, for example, chips and dip (not shown), or beverages and other service items. The sizes of each individual storage receptacle may vary depending on the intended use. For example, the compartmented container 54 in the illustrated embodiment includes both shallow first storage receptacles 60 and deep second storage receptacles 62, e.g., defining different depths. These storage receptacles 60, 62 can be formed separately and independently, or may be a unitary piece as shown in FIG. 5. For example, the shallow storage receptacles 60 may have a width of 10 and 7/16 inches, a length of 6 and ⅜ inches, and a depth of 4 inches, while the deep storage receptacles 62 have a width of 10 and 7/16 inches, a length of 12 and ¾ inches, and a depth of 7 and ⅞ inches. In such an embodiment, the overall dimensions of the compartmented container 54 are a width of 20 and ⅞ inches and a length of 19 and ⅛ inches. In other various embodiments, the number and size of storage receptacles may vary. For example, a compartmented container may include two shallow storage receptacles (e.g., width of 10 and 7/16 inches) and one deep storage receptacle (e.g., width of 20 and ⅞ inches). In another exemplary embodiment, a compartmented container may include three shallow storage receptacles (e.g., width of 6 and 15/16 inches) and one deep storage receptacle (e.g., width of 20 and ⅞ inches). Other variations will be well understood to be within the scope of this embodiment of the invention.

Figure 6:
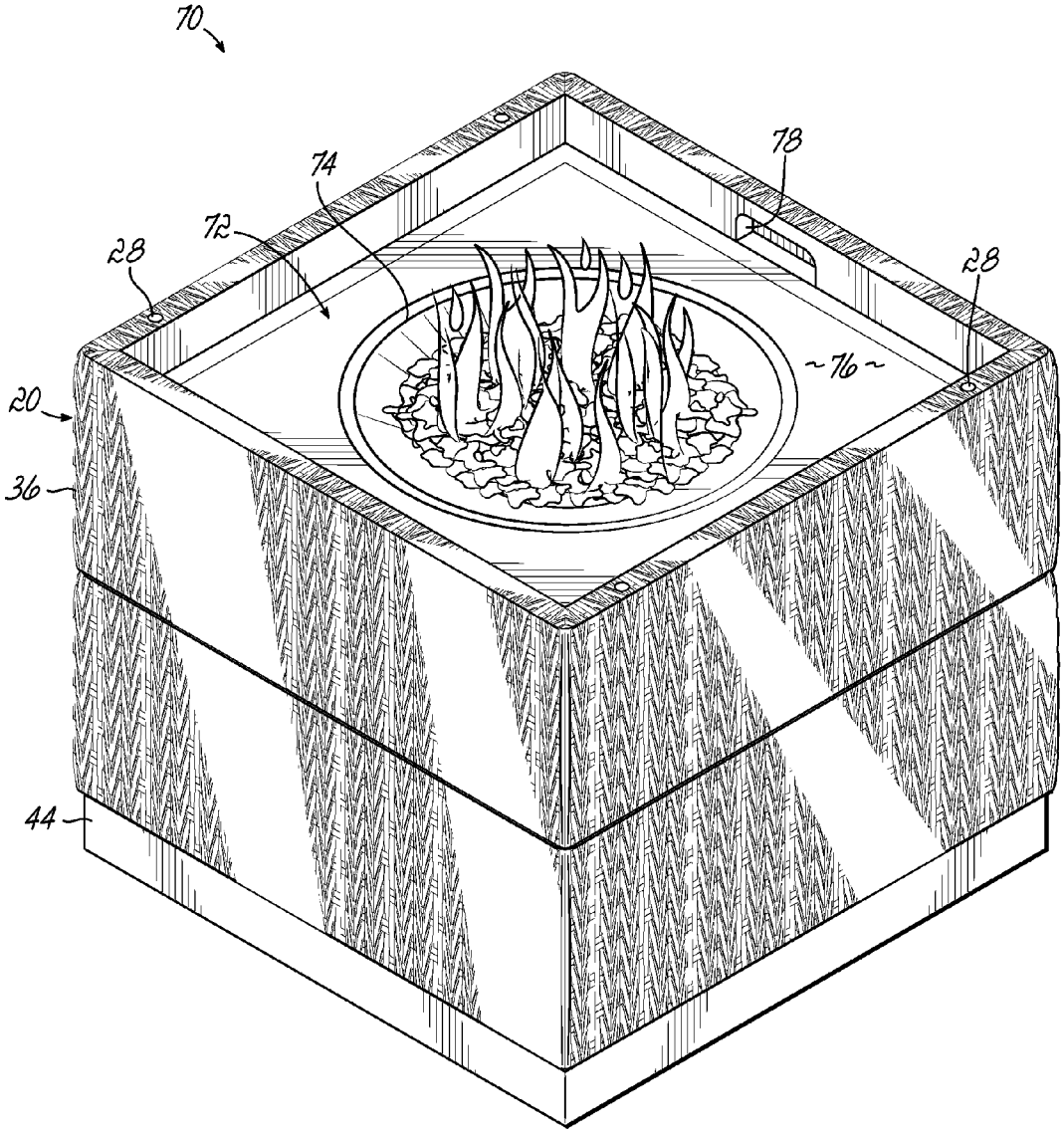
FIG. 6 is a perspective view of a patio table in accordance with another embodiment of the invention and with a tabletop lid member removed to reveal an optional fire pit in the interior thereof.

With reference to FIG. 6, in yet another embodiment of the invention, a convertible outdoor patio table 70 is shown. The same elements from prior embodiment(s) are labeled with the same reference numbers where they remain substantially identical, without a corresponding repeat of the description herein. The shoulder 24 supports a different type of functional/storage device, which is illustrated as a fire pit device 72 in this embodiment. The fire pit device 72 may include a fire bowl 74 for holding combustible materials. To this end, an exemplary type of fire bowl developed by the assignee of the present application are disclosed, for example, in U.S. patent application Ser. No. 15/222,235 to Mueller et al., which was expressly incorporated by reference above. For safety reasons, the fire bowl 74 does not fully extend to the shoulder 24. Accordingly, the fire pit device 72 includes a top surface 76 that extends from the fire bowl 74 to an outer edge of the fire pit device 72, which is supported by the shoulder 24. Nevertheless, the space used by the fire bowl 74 and the fire pit device 72 continues to be maximized relative to the hollow interior 19, as with the other embodiments of the patio table. The fire pit device 72 and its embodiment is an optional possible feature, and it will be understood that this element in FIG. 6 could be replaced by the bowls or containers described above, as well as with a garbage container in other embodiments.

Further, the table 70 includes an internal handle 78 defined by a cutout formed in the outer body member 20 just below the top end and periphery thereof, wherein the handle 78 may be used to lift or move the table 70. In this regard, a periphery of the outer body member 20 extends above the shoulder 24 and includes a cutout located immediately above the shoulder 24 that defines the internal handle 78, although the particular size and arrangement of the cutout may be modified in other embodiments as necessary.

Figure 7A:
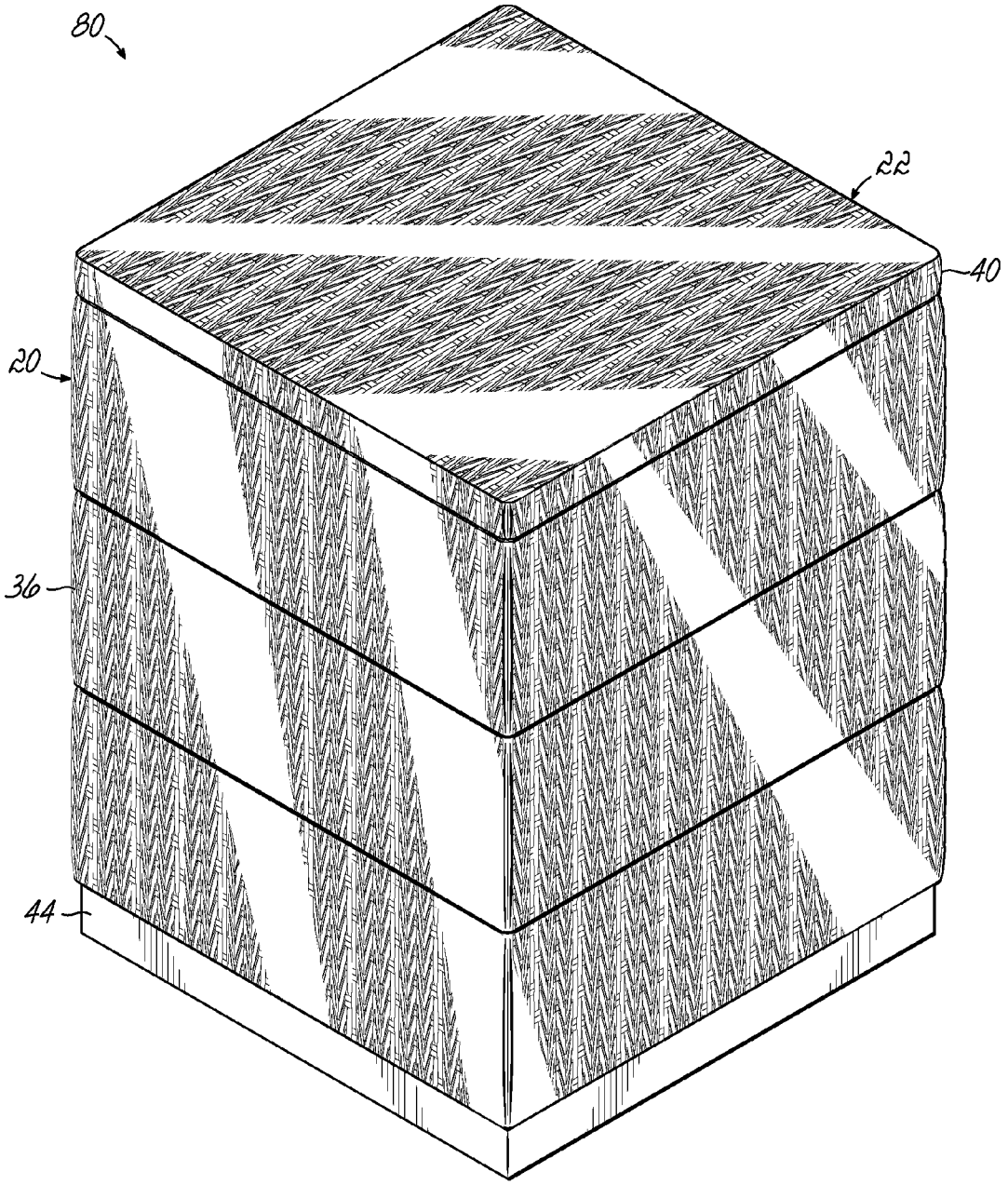
FIG. 7A is a perspective view of a patio table in accordance with another embodiment of the invention showing a taller, medium table height, with a tabletop lid member thereof in a closed position.
Figure 7B:
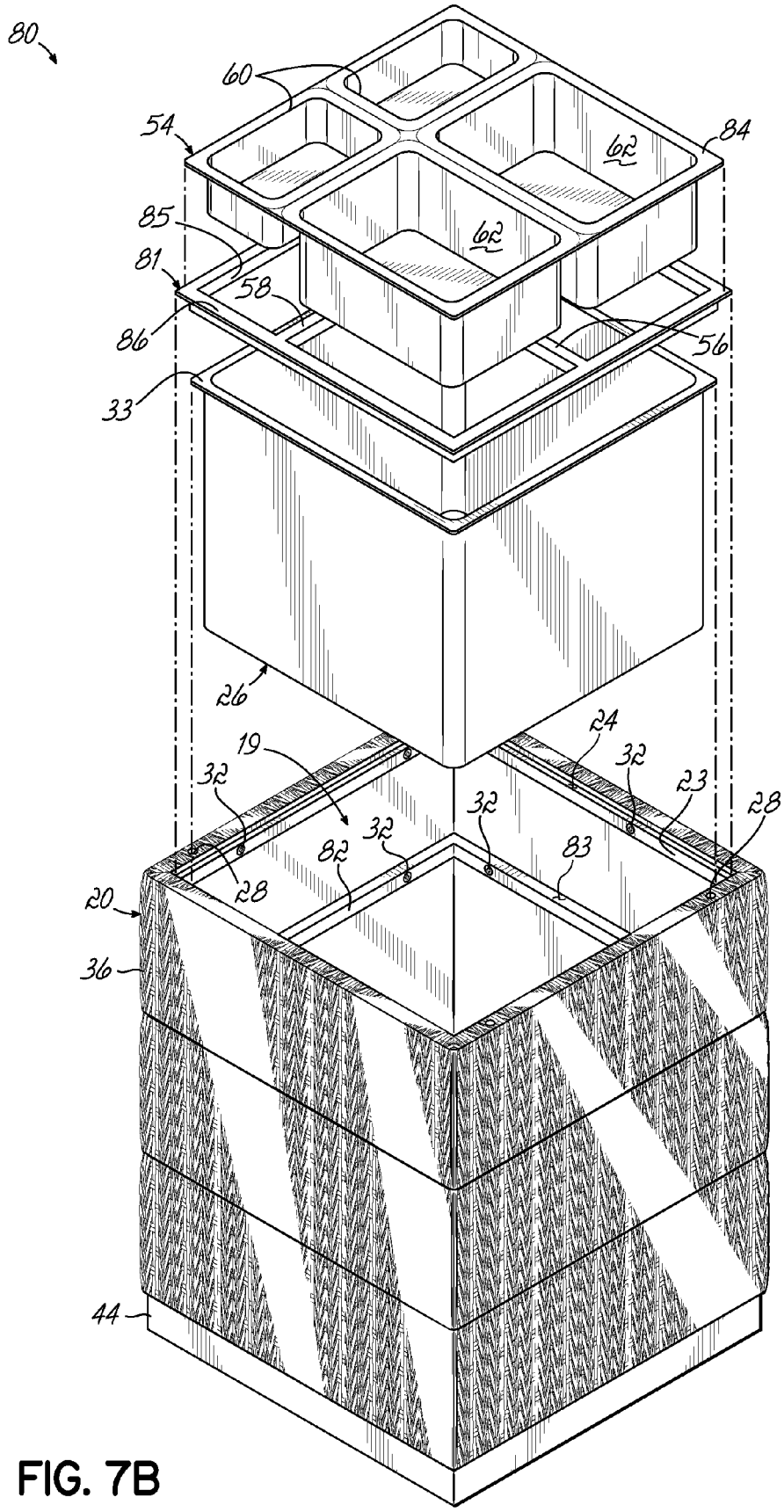
FIG. 7B is an exploded perspective view of the table of FIG. 7A, with the tabletop lid member removed (and not shown) to reveal multiple functional/storage devices and multiple internal railings used in taller embodiments of the table.
Figure 8:
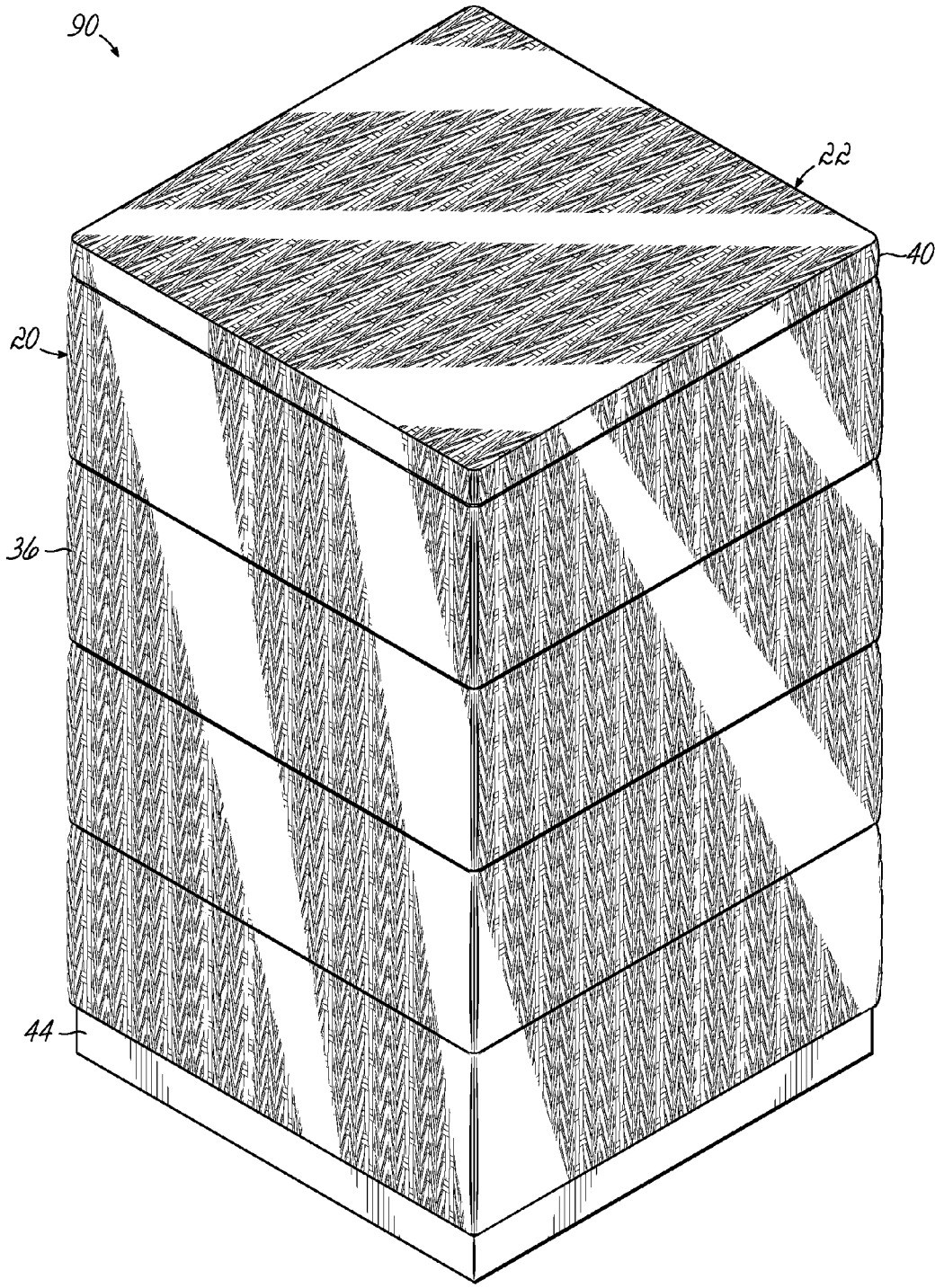
FIG. 8 is a perspective view of a patio table in accordance with another embodiment of the invention showing a taller, large table height.
Figure 9:
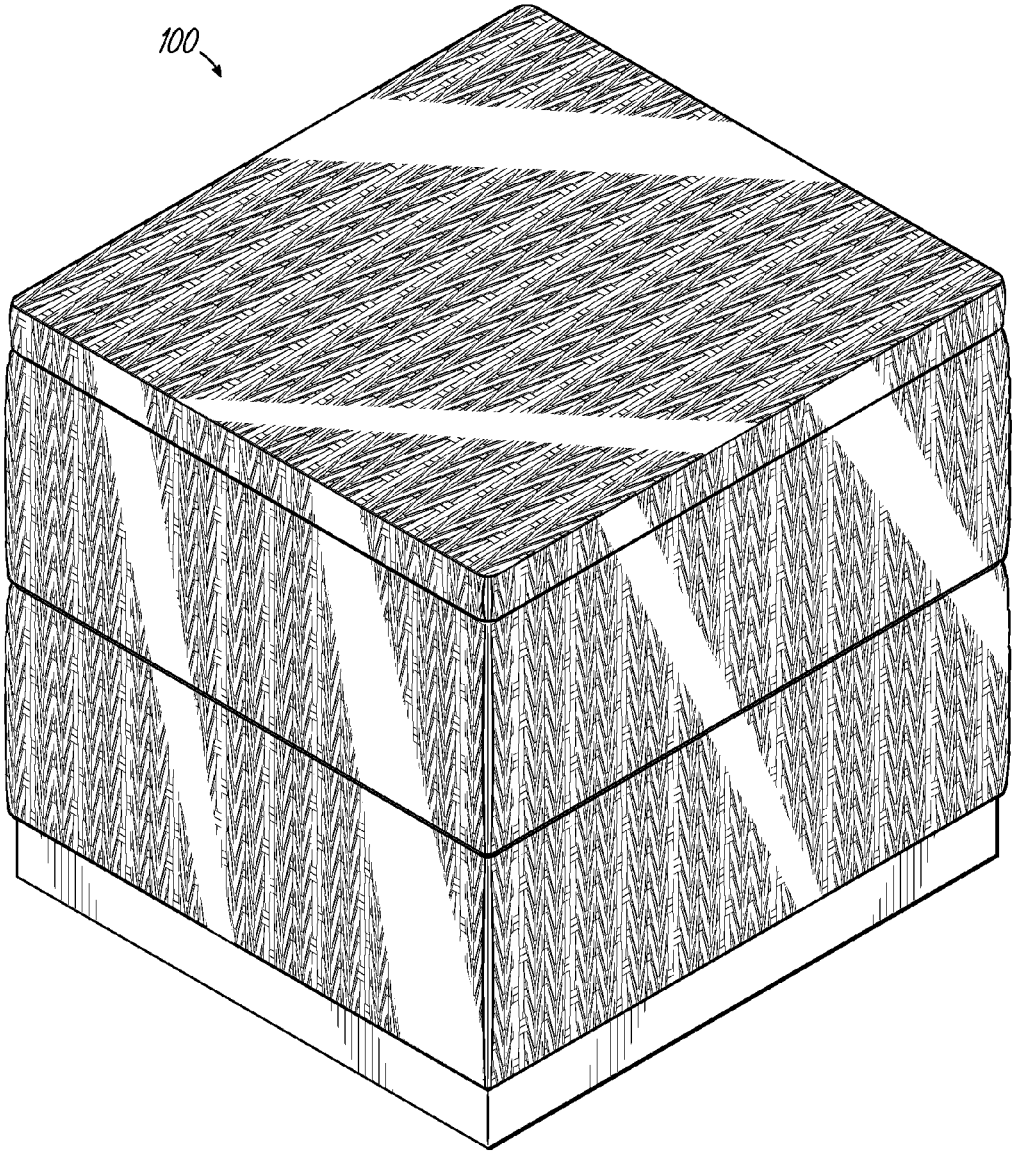
FIG. 9 is a top isometric view of a patio table in accordance with another embodiment of the invention, showing the ornamental features thereof.
Figure 10:
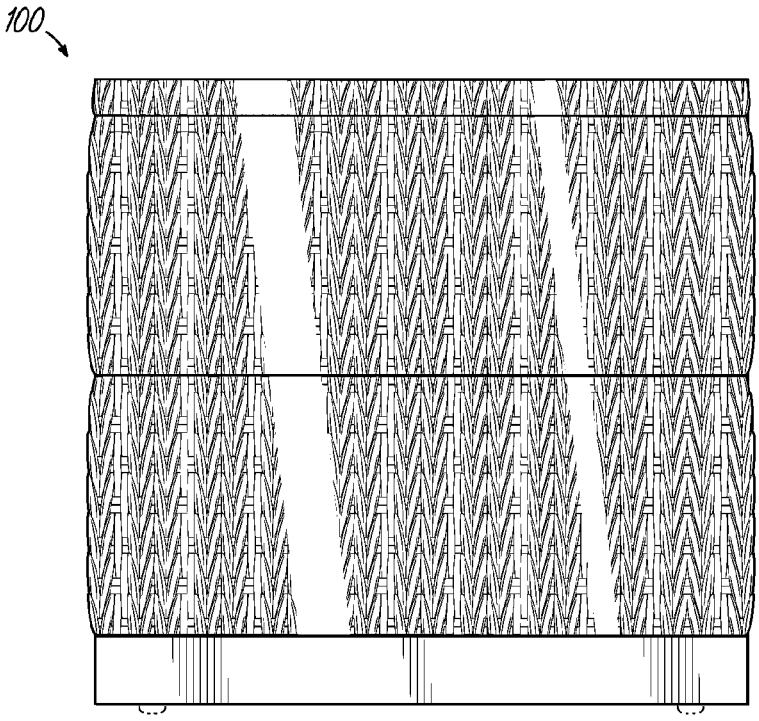
FIG. 10 is a front view of the table of FIG. 9, with the rear view being identical.
Figure 11:
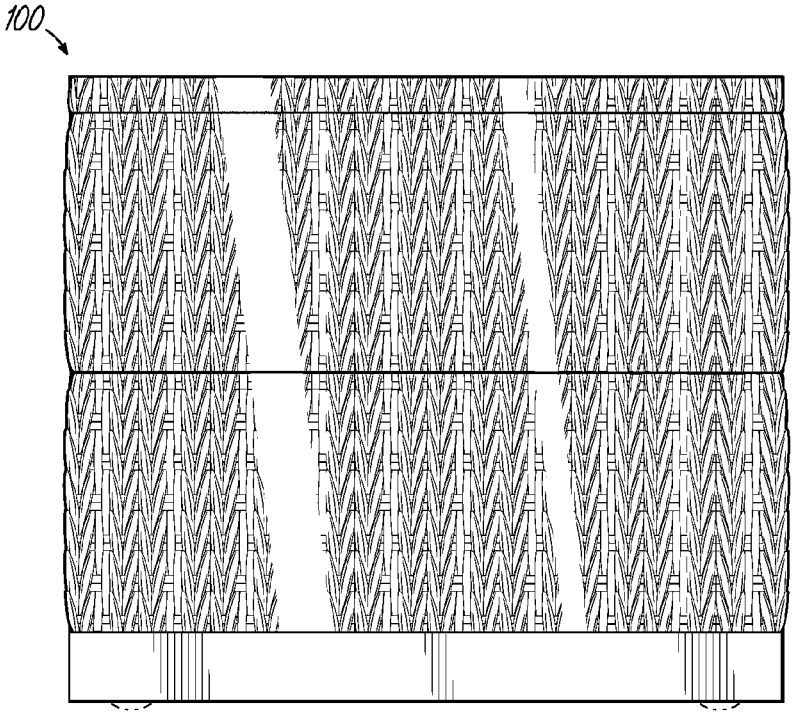
FIG. 11 is a right side view of the table of FIG. 9, with the left side view being identical.
Figure 12:
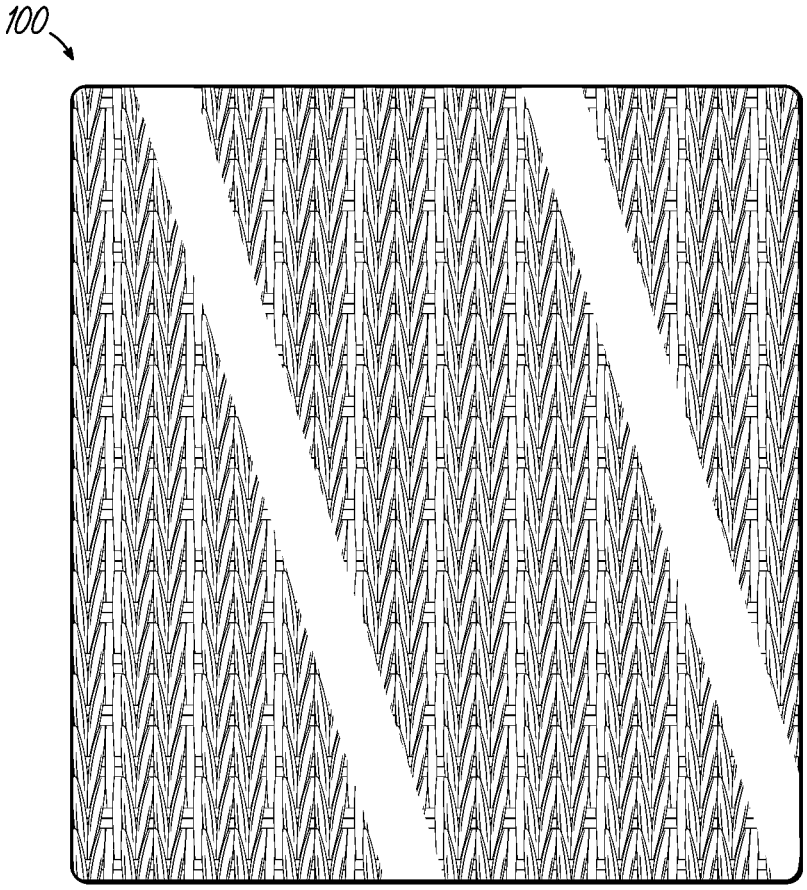
FIG. 12 is a top view of the table of FIG. 9.

In an aspect of the present invention, it will be recognized that the dimensions of a patio table may vary based on the intended use, and based on whether multiple functionalities are desired within the interior of the patio table. With reference to FIG. 1, the table 10 has a height (measured in a vertical direction) that is less than each of the length and width (each measured in the horizontal direction) of the table 10. In one embodiment, the height may be 18 and ⅞ inches, the length may be 22 and ¼ inches, and the width may be 24 inches. With reference to FIGS. 7A, 7B and 8, tables 80 and 90 of other embodiments of the invention are shown having varying table heights for different settings. The heights of tables 80, 90 are greater than each of their respective lengths and widths. In the embodiment of FIGS. 7A and 7B, the height of the table 80 may be 33 and ⅞ inches, the length may be 22 and ¼ inches, and the width may be 24 inches. In the embodiment of FIG. 8, the height of the table 90 may be 41 and ⅜ inches, the length may be 22 and ¼ inches, and the width may be 24 inches. Further, as shown in FIGS. 1, 7A, 7B, and 8, the outer body member 20 of each of the tables 10, 80, 90 is shown with a ridged or grooved profile so as to appear segmented. The number of segments may be varied depending on the desired table height. In an embodiment, each segment may have a height of 7 and ½ inches. Of course, it will be understood that the outer body member 20 may omit such segments and define a unitary, smooth appearance and profile along the entire height thereof, regardless of whether the patio table is a low, medium, or high construction (in vertical height).

The taller versions of the patio tables 80, 90 shown in FIGS. 7A through 8 also provide an opportunity for multiple internal railings and multiple functional/storage devices to be provided, which allows for multiple functionalities to be achieved inside the patio tables 80, 90. One particular example of such an arrangement is shown in detail in the exploded view of FIG. 7B, at the medium height version of the patio table 80. As with previous embodiments, the same elements from prior embodiment(s) are labeled with the same reference numbers where they remain substantially identical, without a corresponding repeat of the description herein.

As shown in FIG. 7B, the table 80 includes multiple internal railings within the generally hollow interior 19. For example, a first railing 23 (effectively identical to the one shown in FIGS. 2B and 3) which defines a shoulder 24 is once again coupled to the frame 12 adjacent a top end 14 thereof. This coupling can be made removable by using threaded fasteners 32 or some other similar type of connection element. The first railing 23 does not include any crossbars, but such elements can be provided, where necessary, by a supplemental removable railing 81 described in further detail below. The table 80 also includes a second railing 82 which also defines a shoulder 83, this second railing 82 being secured (such as by threaded fasteners 32 or the like) to the frame 12 at a location part of the way down the height of the generally hollow interior 19. As shown in FIG. 7B, the shoulder 83 of the second railing 82 is generally larger in size or thickness projecting away from the frame 12 as compared to the shoulder 24 located on the first railing 23. This relative size difference allows the shoulder 83 on the second railing 82 to support a functional/storage device which is small enough in cross-section to pass through the opening at the smaller first railing 23 and shoulder 24. It will be understood that still further railings beyond the two shown could be added to the interior 19 at different heights, particularly in taller table designs, such as the one shown in FIG. 8.

As alluded to above, the arrangement shown in FIG. 7B allows the patio table 80 to provide multiple internal functionalities, specifically by having multiple functional/storage devices that can be used when the tabletop lid member 22 is removed. Thus, in one example, the patio table 80 accommodates both a unitary storage receptacle 26 in the form of an ice bucket or chest as well as a compartmented container 54. As shown in the example of FIG. 7B, the ice bucket 26 includes the outwardly projecting lip 33 around a top periphery that engages with or sits upon the shoulder 83 defined by the second railing 82. This positions the ice bucket 26 in a lower portion of the generally hollow interior 19. The outwardly projecting lip 33 is small enough to allow the ice bucket 26 to pass through the opening defined by the shoulder 24 at the first railing 23, thereby enabling insertion and removal of this functional/storage device without disassembling the first railing 23 from the frame 12.

Above this ice bucket 26, the compartmented container 54 is supported by placing an outwardly projecting lip 84 of the compartmented container 54 on the shoulder 24 of the first railing 23. The supplemental railing 81 may optionally be placed on top of the shoulder 24 before the lip 84 of the compartmented container 54, such as when intermediate support with crossbars 56, 58 extending across the open space at the top of the generally hollow interior 19 is desired for the compartmented container 54. The supplemental railing 81 defines a peripheral support portion 85 having a lip 86 which sits atop the shoulder 24 to hold the supplemental railing 81 in position. The crossbars 56, 58 are typically formed integrally as a unitary piece with the peripheral support portion 85 such that placement of the peripheral support portion 85 on top of the first railing 23 also positions the crossbars 56, 58 in an appropriate position for receiving and supporting the compartmented container 54 at locations between the storage receptacles 60, 62 thereon. Thus, by placing the supplemental railing 81 on the first railing 23 at shoulder 24 and then placing the compartmented container 54 on top of the supplemental railing 81, the chip and dip containers are provided as another functional/storage device in an upper portion of the generally hollow interior 19.

Accordingly, the patio table 80 of this embodiment advantageously provides multiple functionalities in the same hollow interior 19. To this end, a medium size patio table 80 may include any two functional/storage devices chosen from the compartmented container 54 for chips and dip, the unitary storage receptacle 26 in the form of an ice bucket, and/or a trash receptacle (which is similar in structure as the unitary storage receptacle or ice bucket); moreover, a larger size patio table 90 such as the one shown in FIG. 8 may have sufficient interior space for all three of those functional/storage devices at the same time. It will be understood that the particular positioning of the railings and the arrangement of one or more functional/storage devices may vary in different embodiments without departing from the scope of this invention.

With reference to FIGS. 9 through 12, a particular new original design of a convertible outdoor patio table 100 is shown in accordance with one embodiment of the invention. The convertible outdoor patio table 100 is shown with the tabletop lid member in position as will be understood from the description of the previous embodiments above. In this configuration, the ornamental and aesthetic features of this embodiment of the patio table 100 are evident. To this end, a majority of the visible exterior of patio table 100 includes a wicker-like material or appearance, which is desirable in some outdoor contexts. The broken lines in these figures (at the wheels) are shown for the purpose of illustrating boundaries of the claimed design and the areas inside the broken line boundaries form no part of the claimed design.

With reference to FIGS. 13 through 16, another particular new original design of a convertible outdoor patio table 110 is shown in accordance with yet another embodiment of the invention. The convertible outdoor patio table 110 is shown with the tabletop lid member 112 in position as will be understood from the description of the previous embodiments above (and further described below as well). In this configuration, the ornamental and aesthetic features of this embodiment of the patio table 110 are evident. To this end, a majority of the visible exterior of patio table 110 except at the tabletop lid member 112 includes a wicker-like material or appearance, which is desirable in some outdoor contexts. The broken lines in these figures (at the wheels and at a handle 114 on the tabletop lid member 112) are shown for the purpose of illustrating boundaries of the claimed design and the areas inside the broken line boundaries form no part of the claimed design.

In the embodiment of the patio table 110 shown in FIGS. 13 through 16, the tabletop lid member 112 is configured differently both in materials and in how it interacts with the outer body member 120. To this end, while other elements like the frame 12 and the skirt 44 may be the same as previous embodiments (with the same reference numbers applied without further description of the identical elements herein), the tabletop lid member 112 includes at least an outer decorative layer defining a top surface 122 formed from a wood or composite laminate material. This material provides the patio table 110 of this embodiment with a distinctive yet desirable appearance for outdoor furniture, as the wood or composite laminate material is colored or stained to complement the material defining an outer decorative layer of the outer body member 120. The tabletop lid member 112, similar to previously-described embodiments, may also include an inner backing layer made from a weather-resistant material such as plastics like polyvinyl chloride.

Another distinctive feature of this embodiment of the patio table 110 is how the tabletop lid member 112 engages with the remainder of the patio table 110 in the engaged position to define a generally flat tabletop at the top surface 122. The outer body member 120 defines a periphery 124 that projects upwardly to a top surface 126 located above the railing which defines the shoulder 24 in the hollow interior 19. This arrangement is similar to the one previously described with respect to the embodiment shown in FIG. 6. This projection of the top surface 126 and the periphery 124 above the shoulder 24 is sized with generally the same thickness as the tabletop lid member 112 such that when the tabletop lid member 112 is laid on top of the shoulder 24 (instead of being supported with pins in apertures as with other embodiments), the tabletop lid member 112 is surrounded around its edges by the periphery 124 of the outer body member 120. Furthermore, the top surface 122 of the tabletop lid member 112 is positioned or placed on the shoulder 24 in such a manner as to be substantially flush with the top surface 126 of the periphery 124 and to define the generally planar tabletop across an entirety of the patio table 110. It will be understood that other types of supporting and coupling the tabletop lid member 112 to the remainder of the patio table 110 may be used in other similar embodiments without departing from the scope of this disclosure.

As a result of the tabletop lid member 112 effectively nesting within the periphery 124 when engaged with the shoulder 24 in this embodiment, it can be advantageous to include the handle 114 as a device for assisting with removal of the tabletop lid member 112 when desired to use the functional/storage device (not shown) located within the patio table 110. The handle 114 is specifically shown as a metallic ring handle which can pivot relative to the top surface 122, but it will be understood that different handle configurations and materials could be used in other similar embodiments. In this regard, the handle 114 does not significantly impact the use of a generally flat tabletop area when the tabletop lid member 112 is in the engaged position as shown in FIGS. 13 through 16, but it is present to simplify removal of the tabletop lid member 112 when desired to convert the patio table 110 to its other uses, as set forth in great detail above regarding other embodiments.

In accordance with one embodiment of the patio table as described above, wherein the railing is a first railing, and the functional/storage device is a first functional/storage device, the patio table further comprises: a second railing coupled to the frame below the first railing and defining a second shoulder positioned at the generally hollow interior; and a second functional/storage device which is revealed for access and use when both of the tabletop lid member and the first functional/storage device are disengaged and removed from the outer body member, wherein the second functional/storage device removably engages with the second shoulder to position the second functional/storage device in the generally hollow interior below the first functional/storage device.

In accordance with a further embodiment of the patio table above, the first and second functional/storage devices are selected from one or more of the following: an ice bucket, a compartmented container with multiple storage receptacles, and a trash receptacle.

While the present invention has been illustrated by a description of exemplary embodiments and while these embodiments have been described in some detail, it is not the intention of the Applicant to restrict or in any way limit the scope of the appended claims to such detail. Additional advantages and modifications will readily appear to those skilled in the art. The various features of the disclosure may be used alone or in any combination depending on the needs and preferences of the user. Further, features that are described and/or illustrated with respect to one embodiment may be used in the same way or in a similar way in one or more other embodiments and/or in combination with or instead of the features of the other embodiments. This has been a description of the present invention, along with the preferred methods of practicing the present invention as currently known. However, the invention itself should only be defined by the appended claims.

What is claimed is:

1. A convertible outdoor patio table, comprising:

a metallic frame configured to be mounted on wheels, the frame defining a top end, a bottom end configured to be connected to the wheels, and side portions extending between the top end and the bottom end, the frame surrounding a generally hollow interior;

an outer body member which is coupled to and substantially surrounds the side portions of the frame, the outer body member being at least partially made of a weather resistant material;

a railing coupled to the frame proximate the top end and defining a shoulder positioned adjacent the outer body member at the generally hollow interior;

a tabletop lid member which removably engages with at least one of the shoulder or the outer body member adjacent the top end of the frame to close the generally hollow interior from an external environment and provide a generally planar tabletop surface for supporting various articles, the tabletop lid member being at least partially made of a weather resistant material; and a functional/storage device which is revealed for access and use when the tabletop lid member is disengaged from the outer body member, wherein the functional/storage device removably engages with the shoulder and substantially covers a surface area bounded by the railing to maximize usage of space within the generally hollow interior, wherein the functional/storage device is inserted and removed by moving in a vertical direction through the opening created by removing the tabletop lid, and wherein the shoulder is positioned underneath the functional/storage device and supports the weight of the functional/storage device.

2. The patio table of claim 1, wherein the outer body member includes an inner backing layer formed from a plastic material and an outer decorative layer, such that each of the inner backing layer and the outer decorative layer is weather resistant.

3. The patio table of claim 1, wherein the tabletop lid member includes an inner backing layer formed from a plastic material and an outer decorative layer, such that each of the inner backing layer and the outer decorative layer of the tabletop lid member is weather resistant.

4. The patio table of claim 1, further comprising:

one or more pins coupled to the tabletop lid member; and one or more apertures in the outer body member, wherein each of the one or more pins is insertable into one of the one or more apertures to removably engage the tabletop lid member and the outer body member.

5. The patio table of claim 1, wherein a periphery of the outer body member projects upwardly above the shoulder, and the shoulder supports the tabletop lid member when the tabletop lid member is engaged with a remainder of the patio table by placing the tabletop lid member on top of the shoulder with the tabletop lid member surrounded by the periphery of the outer body member, thereby positioning the generally planar tabletop surface of the tabletop lid member substantially flush with the periphery of the outer body member.

6. The patio table of claim 5, further comprising:

a handle coupled to the tabletop lid member.

7. The patio table of claim 1, wherein a periphery of the outer body member extends above the railing, the outer body member including a handle formed by a cutout in the outer body member positioned above the railing.

8. The patio table of claim 1, wherein the functional/storage device is a unitary storage receptacle defining an ice chest.

9. The patio table of claim 1, wherein the functional/storage device is a compartmented container defined by multiple storage receptacles.

10. The patio table of claim 9, wherein the compartmented container includes at least a first storage receptacle and a second storage receptacle, the first and second storage receptacles having different depths.

11. The patio table of claim 1, further comprising:

a skirt coupled to the bottom end of the frame, the skirt having a bottom surface, wherein a bottom edge of each wheel extends further from the bottom end of the frame than the bottom surface of the skirt.

12. The patio table of claim 11, wherein the skirt is made of aluminum.

13. The patio table of claim 1, wherein the patio table defines a height in a vertical direction and also defines a width and a length in a horizontal direction, the height being less than each of the width and the length.

14. The patio table of claim 1, wherein the patio table defines a height in a vertical direction and also defines a width and a length in a horizontal direction, the height being greater than each of the width and the length.

15. The patio table of claim 1, wherein the railing is a first railing, and the patio table further comprises:

a second railing coupled to the frame below the first railing and defining a second shoulder positioned at the generally hollow interior.

16. The patio table of claim 1, wherein the railing is flush against the outer body member.

17. A convertible outdoor patio table, comprising:

a metallic frame configured to be mounted on wheels, the frame defining a top end, a bottom end configured to be connected to the wheels, and side portions extending between the top end and the bottom end, the frame surrounding a generally hollow interior;

an outer body member which is coupled to and substantially surrounds the side portions of the frame, the outer body member being at least partially made of a weather resistant material;

a railing coupled to the frame proximate the top end and defining a shoulder positioned adjacent the outer body member at the generally hollow interior, wherein the railing includes one or more crossbars that provide support to the compartmented container between two or more of the multiple storage receptacles;

a tabletop lid member which removably engages with at least one of the shoulder or the outer body member adjacent the top end of the frame to close the generally hollow interior from an external environment and provide a generally planar tabletop surface for supporting various articles, the tabletop lid member being at least partially made of a weather resistant material; and a functional/storage device which is revealed for access and use when the tabletop lid member is disengaged from the outer body member, wherein the functional/storage device removably engages with the shoulder and substantially covers a surface area bounded by the railing to maximize usage of space within the generally hollow interior, wherein the functional/storage device is inserted and removed by moving in a vertical direction through the opening created by removing the tabletop lid, wherein the shoulder is positioned underneath the functional/storage device and supports the weight of the functional/storage device, and wherein the functional/storage device is a compartmented container defined by multiple storage receptacles.

* * * * *